US008689590B2

(12) United States Patent
Madruga et al.

(10) Patent No.: US 8,689,590 B2
(45) Date of Patent: Apr. 8, 2014

(54) UTILITY ENCLOSURE VANDAL GUARD WITH SHACKLE COVER

(75) Inventors: Joseph Raymond Madruga, San Jose, CA (US); Raymond Michael Madruga, San Ramon, CA (US)

(73) Assignee: Madruga Iron Works, Inc., Tracy, CA (US)

( * ) Notice: Subject to any disclaimer, the term of this patent is extended or adjusted under 35 U.S.C. 154(b) by 0 days.

(21) Appl. No.: 13/538,743

(22) Filed: Jun. 29, 2012

(65) Prior Publication Data

US 2014/0000328 A1 Jan. 2, 2014

(51) Int. Cl.
*E05B 67/38* (2006.01)

(52) U.S. Cl.
USPC ..... 70/56; 70/54; 70/16; 70/164; 70/416

(58) Field of Classification Search
USPC ..... 70/54–56, 163, 164, 166–169, 416, 417
See application file for complete search history.

(56) References Cited

U.S. PATENT DOCUMENTS 4,896,518 A * 1/1990 Appelgren ..... 70/54
5,737,946 A * 4/1998 Sole et al. ..... 70/54
5,966,876 A * 10/1999 Neathery et al. ..... 52/20
6,082,601 A * 7/2000 Standish ..... 224/569
6,405,570 B1 * 6/2002 Middleton et al. ..... 70/174
6,519,982 B1 * 2/2003 Brammall et al. ..... 70/56
6,526,786 B1 * 3/2003 Kayoda ..... 70/56
6,527,312 B1 * 3/2003 Jackovino et al. ..... 292/282
6,616,201 B1 * 9/2003 Liang ..... 292/207
6,735,989 B1 * 5/2004 Schramm et al. ..... 70/2
7,278,284 B1 * 10/2007 James ..... 70/56
7,975,515 B2 * 7/2011 Ygnelzi et al. ..... 70/168
8,011,213 B1 * 9/2011 Gogel ..... 70/56
8,020,414 B2 * 9/2011 Pitisethakarn ..... 70/14
8,220,296 B2 * 7/2012 Boonstra et al. ..... 70/2
8,245,546 B2 * 8/2012 Olsson ..... 70/14
2004/0244444 A1 * 12/2004 Wadsworth ..... 70/168
2005/0103065 A1 * 5/2005 Dennis ..... 70/56
2005/0247084 A1 * 11/2005 Rosenberg et al. ..... 70/32
2007/0062227 A1 * 3/2007 Thomsen ..... 70/56
2009/0199602 A1 * 8/2009 Diesing ..... 70/55

* cited by examiner

*Primary Examiner* — Suzanne Barrett
(74) *Attorney, Agent, or Firm* — Patent Law Group LLP; David C Hsia

(57) ABSTRACT

A vandal guard for a utility enclosure includes a cover with a cover plate and a shackle cover on top of the cover plate. The shackle cover is located over a slot in the cover plate for receiving a staple. When the staple is secured with a lock, the shackle of the lock is shielded by the shackle cover to protect it from tampering.

7 Claims, 10 Drawing Sheets

UTILITY ENCLOSURE VANDAL GUARD WITH SHACKLE COVER

CROSS-REFERENCE TO RELATED APPLICATION

This application is related to U.S. Application Ser. No. 13/538,726 entitled "Utility Enclosure Vandal Guard with Lock Box," which is concurrently filed, commonly owned, and incorporated herein by reference.

BACKGROUND

As commodities prices rise, metal thieves are increasingly targeting outdoor utility enclosures that contain copper and other metal wiring. Thus there is a need to better protect the utility enclosures against theft of its valuable contents.

BRIEF DESCRIPTION OF THE DRAWINGS

In the drawings.

Use of the same reference numbers in different figures indicates similar or identical elements.

DETAILED DESCRIPTION

Figure 2:
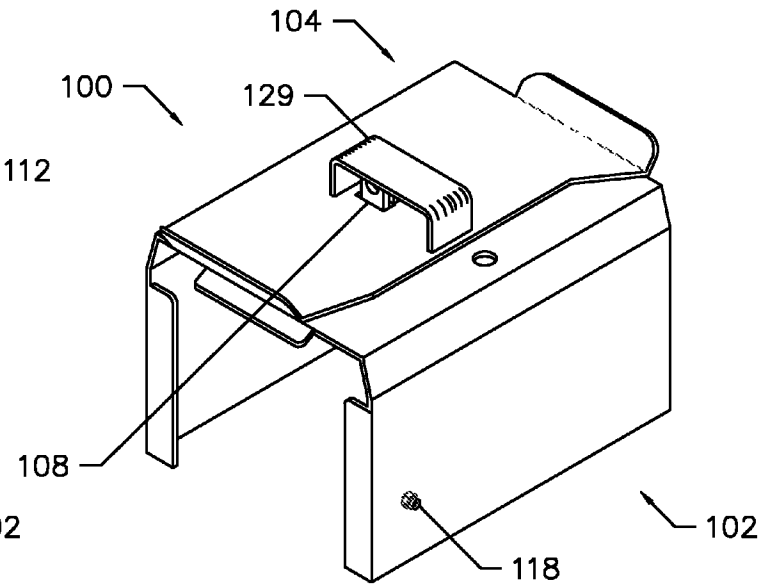
FIGS. 1 and 2 are isometric views of a vandal guard in one example of the present disclosure.
Figure 1:
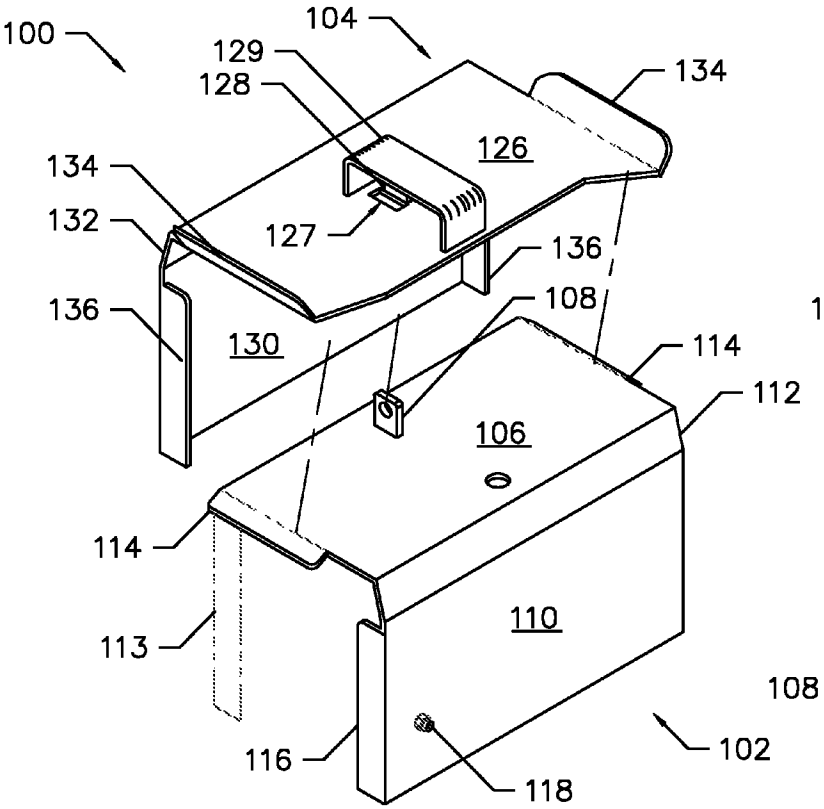

FIGS. 1 and 2 are isometric views of a vandal guard 100 for a utility enclosure in one example of the present disclosure. Vandal guard 100 may be made of steel or other material of comparable strength. Vandal guard 100 includes a first part 102 and a second part 104 that are inserted into the utility enclosure and then locked to each other to cover the valuable contents inside the utility enclosure. Once locked, vandal guard 100 may not be removed from within the utility enclosure. Vandal guard 100 includes a shackle cover 129 that protects the lock against tampering.

First part 102 includes a top face 106 and a vertical staple 108 extending upward from the top surface of face 106. First part 102 may include a side face 110 extending down from top face 106. Side face 110 may be joined by a beveled corner 112 to top face 106. First part 102 may include legs 113 (only one is shown in phantom in FIG. 1) extending downward from opposite edges of top face 106. Top face 106 may be orthogonal to side face 110 and legs 113. Top face 106 may include downward wings 114 on opposite edges adjacent to its edge abutting corner 112. Side face 110 may include studs 116 on opposite edges adjacent to its edge abutting corner 112. A nut 118 (shown in phantom) may be fixed to the interior surface of side face 110 for attaching a ground wire to vandal guard 100. Staple 108 may be a tab defining a hole or a U-shaped bolt.

Second part 104 includes a top face 126 defining a slot 127, a staple 128 adjacent to slot 127, and shackle cover 129 over slot 127 and staple 128. Slot 127 is dimensioned to receive staple 108 (i.e., staple 108 fits in slot 127) when second part 104 is placed atop first part 102. Shackle cover 129 may be a U-shaped strip that is oriented along the length of slot 127. Second part 104 may further include a side face 130 extending down from top face 126. Side face 130 may be joined by a beveled corner 132 to top face 126. Top face 126 and side face 130 may be orthogonal to each other. Top face 126 may include upward wings 134 on opposite edges adjacent to its edge abutting corner 132, and side face 130 may include studs 136 on opposite edges adjacent to its edge abutting corner 132.

Figure 3:
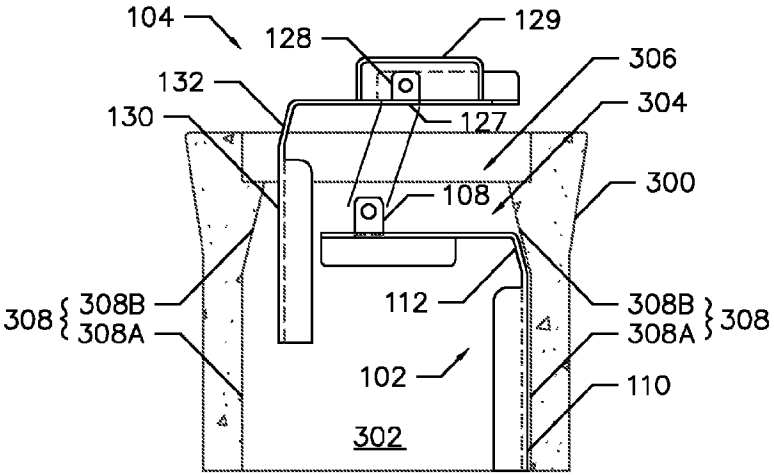
FIG. 3 is an end view of the vandal guard of FIG. 1 during an installation to a utility enclosure in one example of the present disclosure.

FIG. 3 is an end view of vandal guard 100 (FIG. 1) during an installation to a utility enclosure 300 in one example of the present disclosure. Typically utility enclosure 300 is placed in the ground. Utility enclosure 300 defines an interior space with a main section 302 with a constant (e.g., rectangular) cross-section, an upper section 304 with decreasing (e.g., rectangular) cross-sections, and a top section 306 with a constant (e.g., rectangular) cross-section larger than the top of upper section 304. Top section 306 defines a rim for receiving a utility enclosure cover. Utility enclosure 300 has two or more sidewalls 308 with a vertical section 308A and an inward angled section 308B. Side face 110 of first part 102 and side face 130 of second part 104 may have the same height as vertical section 308A, and corner 112 of first part 102 and corner 132 of second part 104 may have the same angle as angled section 308A.

During installation, first part 102 is placed in utility enclosure 300 against a sidewall 308 (e.g., the right sidewall 308 in FIG. 3). Second part 104 is next placed diagonally into utility enclosure 300 against an opposite sidewall 308 (e.g., the left sidewall 308 in FIG. 3). Corner 132 of second part 104 may be pushed against angled section 308B of left sidewall 308 to guide second part 104 diagonally into utility enclosure 300. As second part 104 is about to be fully seated in utility enclosure 300, slot 127 of second part 104 receives staple 108 of first part 102. Note that wings 114, 134 (FIG. 1) and studs 116, 136 (FIG. 1) minimize the gap between vandal guard 100 and utility enclosure 300 to prevent someone from prying open vandal guard 100 and fishing around vandal guard 100 into utility enclosure 300.

Figure 4:
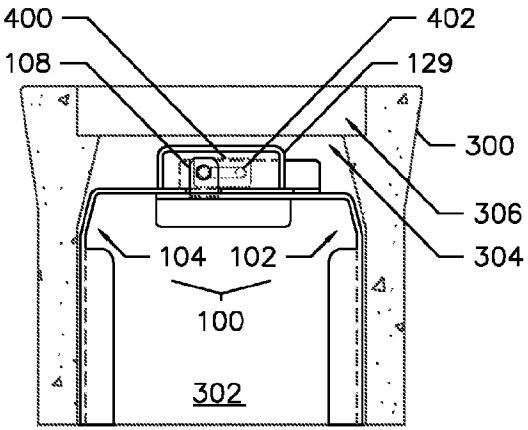
FIGS. 4 and 5 are end and plan views of the vandal guard of FIG. 1 installed to the utility enclosure of FIG. 3 in one example of the present disclosure.
Figure 5:
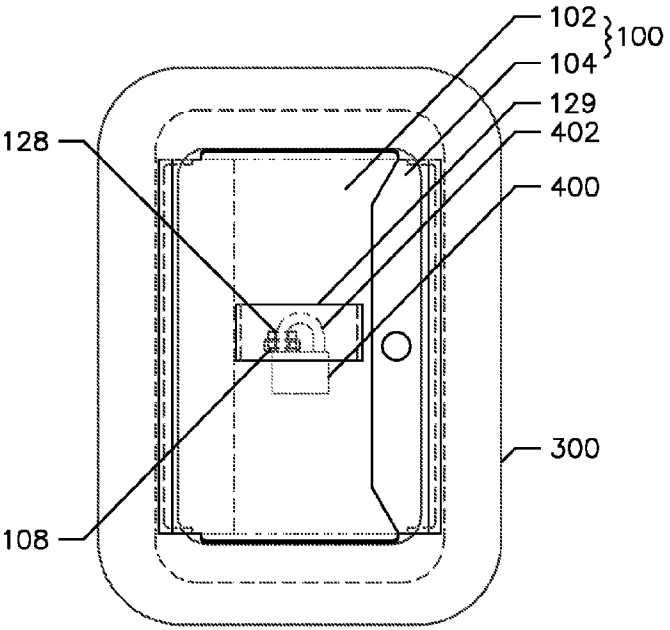

FIGS. 4 and 5 are end and plan views of the vandal guard 100 installed in utility enclosure 300 in one example of the present disclosure. A lock 400 is used to secure vandal guard 100. The open end of a shackle 402 is looped through staples 108 and 128 and back into lock 400. Shackle 402 is protected under shackle cover 129 from tampering (e.g., cutting by a bolt cutter). The width of shackle cover 129 is dimensioned to match the height of shackle 402 so as to cover shackle 402 but expose at least part of the lock body to provide access to the key hole.

Once locked, vandal guard 100 may not be removed from utility enclosure 300 as the width of vandal guard 100 between side faces 110 and 130 is wider than the width of the top opening in upper section 304. The length of vandal guard 100 is dimensioned to be substantially the same as the length of the top opening in upper section 304 so that vandal guard 100 covers main section 302 of utility enclosure 300 and prevents unauthorized access. Note the length of vandal guard 100 is measured between wings 134 and between wings 114 when the wings are present.

Figure 6:
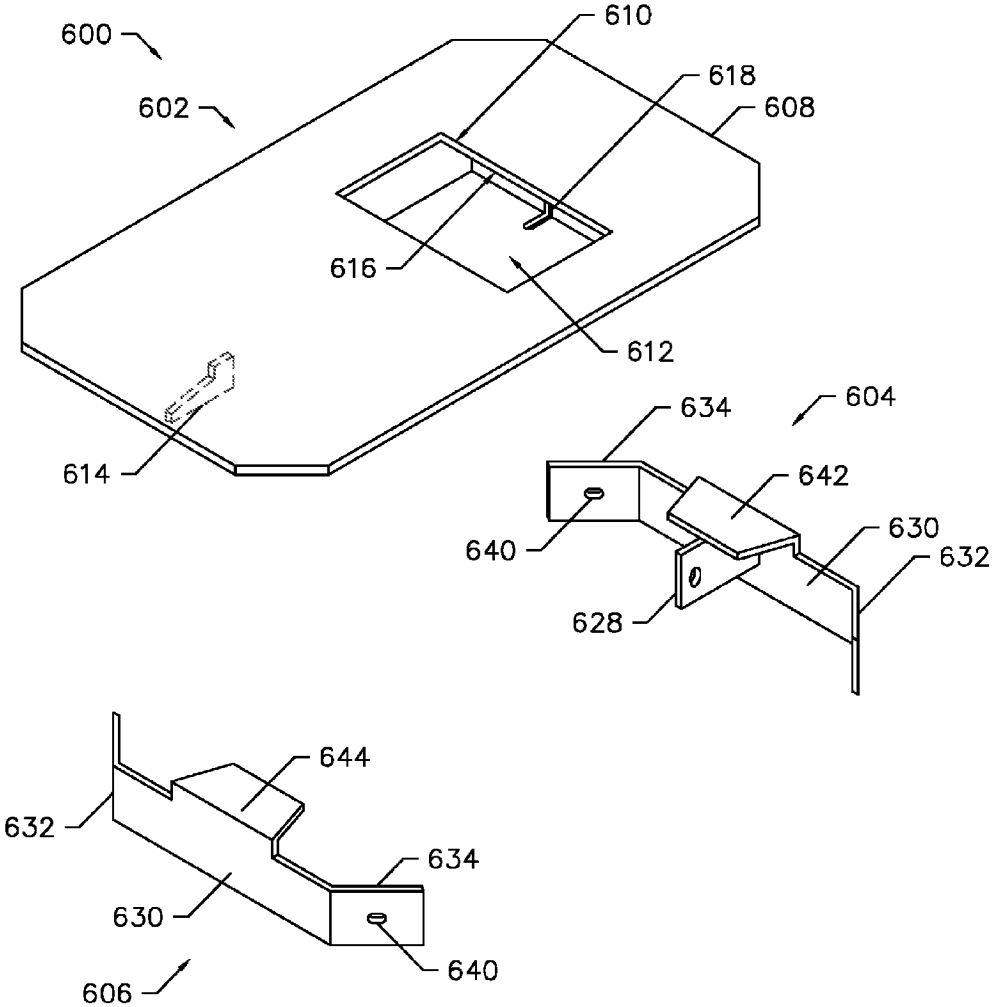
FIG. 6 is an isometric view of a vandal guard in an example of the present disclosure.

FIG. 6 is an isometric view of a vandal guard 600 for a utility enclosure in an example of the present disclosure. Vandal guard 600 may be made of steel or other material of comparable strength. Vandal guard 600 includes a cover 602, a first frame insert 604, and a second frame insert 606. Frame inserts 604 and 606 are fixed to opposite ends of the utility enclosure. Cover 602 is then locked to frame inserts 604 and 606. Cover 602 includes a lock box 612 with a recessed portion 616 that protects the lock against tampering.

Cover 602 includes a cover plate 608 defining an opening 610 adjacent to a first end of cover plate 608, lock box 612 mounted to the bottom of cover plate 608 to partially coincide with opening 610, and one or more hooks 614 (shown in phantom) mounted to the bottom of cover plate 608 at a second end of cover plate 608. Lock box 612 has recessed portion or pocket 616 that extends under cover plate 608 beyond opening 610 toward the first end of cover plate 608. Pocket 616 defines a slot 618. Lock box 612 may be rectangular with a base and four sidewalls, and slot 618 may be defined partially on the base and partially on the sidewall closest to the first end of cover plate 608.

First frame insert 604 has a vertical staple 628 that fits in slot 618 of lock box 612. First frame insert 604 is shaped to match a first end 702 (FIG. 7) of a utility enclosure 700 (FIG. 7) as shown in a plan view in FIG. 7 in one example of the present disclosure. Referring back to FIG. 6, first frame insert 604 may include a center strip 630 joined to bevel corners 632 and 634. Bevel corners 632 and 634 may define fastener holes 640 for fixing first frame insert 604 to first end 702 of utility enclosure 700. Staple 628 may be a vertical tab defining a hole or a U-shaped bolt extending from the interior surface of center strip 630. First frame insert 603 may further include a horizontal tab 642 extending from the top of center strip 630 over staple 628.

Figure 7:
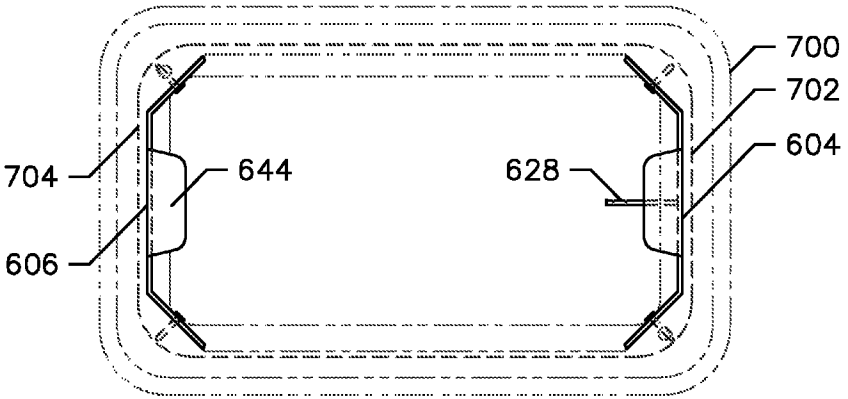
FIG. 7 is a plan view of the vandal guard of FIG. 6 with frame inserts installed to a utility enclosure in one example of the present disclosure.

Second frame insert 606 includes a cover catch 644 for bottom hook 614 of cover 602. Second frame insert 606 is shaped to be fixed to a second end 704 (FIG. 7) of utility enclosure 700 (FIG. 7). For example, second frame insert 606 is of the same or similar construction as first frame insert 604. In second frame insert 606, cover catch 644 corresponds to horizontal tab 642 in first frame insert 604.

Figure 8:
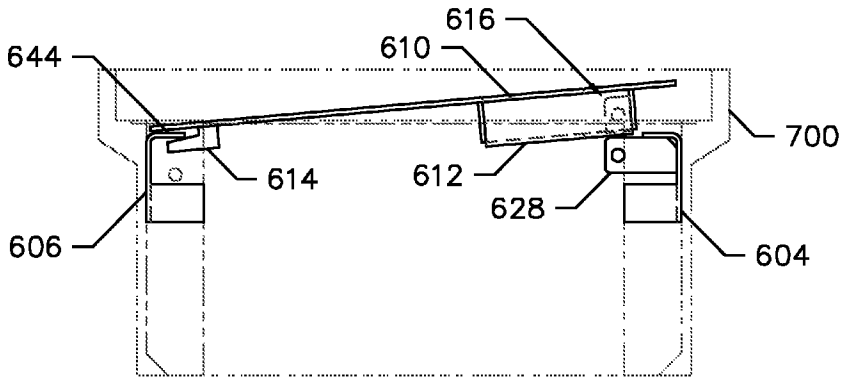
FIGS. 8 and 9 are side and plan views of the vandal guard of FIG. 6 illustrating how a cover engages the frame inserts in one example of the present disclosure.
Figure 9:
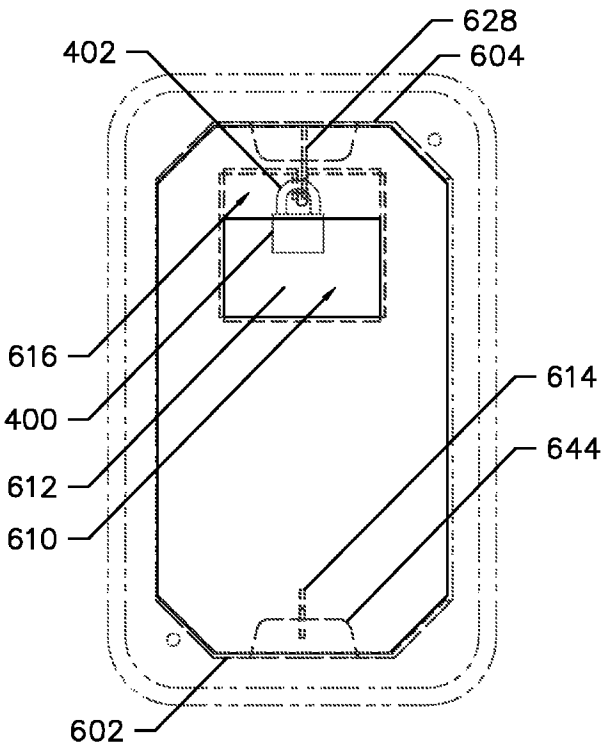

FIGS. 8 and 9 are side and plan views of vandal guard 600 illustrating how cover 602 engages frame inserts 604 and 606 in one example of the present disclosure. First, cover 602 is held diagonally to engage bottom hook 614 at its second end to cover catch 644 of second frame insert 606. Then the first end of cover 602 is placed down so slot 618 defined in lock box 612 receives staple 628 of first frame insert 604. Lock 400 (shown partially in phantom in FIG. 9) is used to secure vandal guard 600. Lock 400 is placed through opening 610 into lock box 612. The open end of shackle 402 is looped through staple 628 and back into lock 400. Shackle 402 is protected under cover plate 608 in pocket 616 from tampering (e.g., cutting by a bolt cutter). The depth of pocket 616 is dimensioned to match the height of shackle 402 so as to cover shackle 402 but expose at least part of the lock body to provide access to the key hole.

Figure 11:
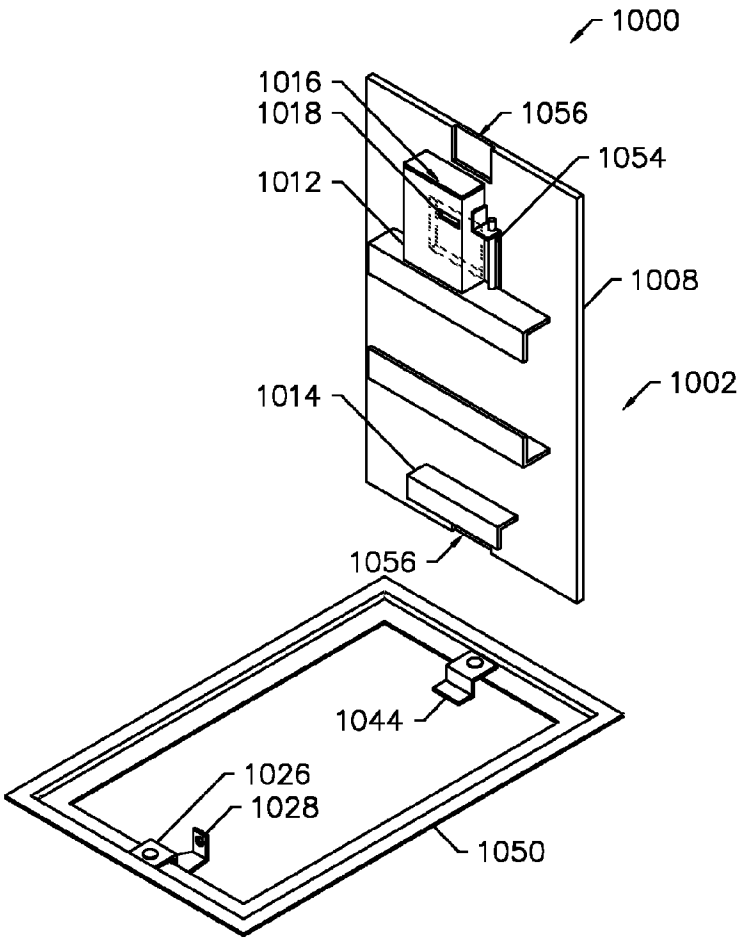
FIGS. 10 and 11 are isometric views of a vandal guard in one example of the present disclosure.
Figure 10:
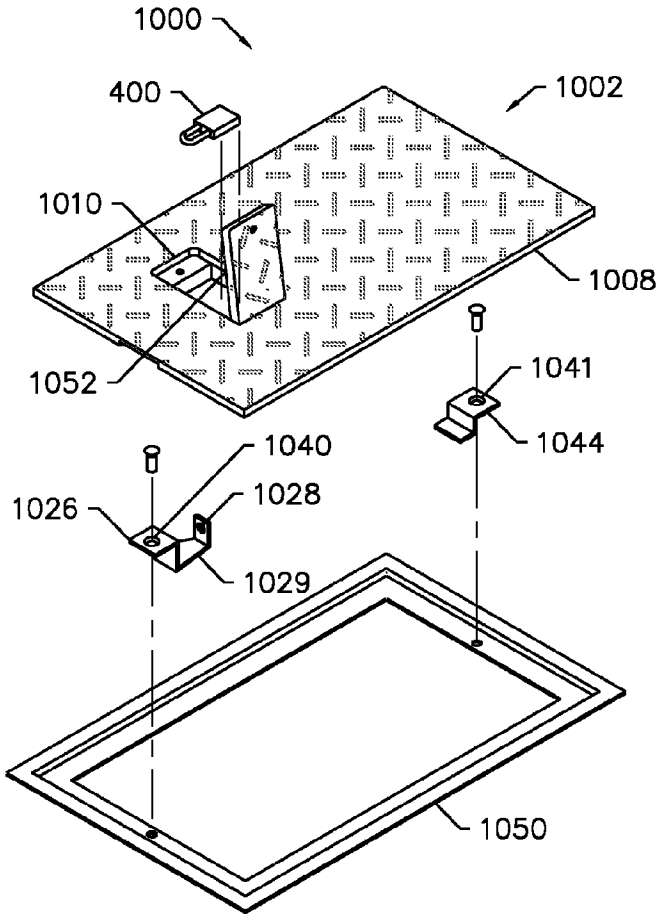

FIGS. 10 and 11 are isometric views of a vandal guard 1000 in one example of the present disclosure. Vandal guard 1000 is a variation of vandal guard 600. Instead of frame inserts, vandal guard 1000 includes a formed lock tab 1026 and a formed cover catch 1044. Lock tab 1026 and cover catch 1044 are fixed to opposite ends of an existing frame 1050 of a utility enclosure. Lock tab 1026 has a vertical staple 1028. Lock tab 1026 may be a Z-bend tab 1029 with one end defining a fastener hole 1040 for fixing lock tab 1026 to frame 1050. Staple 1028 may extend upward from the free end of tab 1029. Cover catch 1044 may be a Z-bend tab with one end defining a fastener hole 1041 for fixing cover catch 1044 to frame 1050.

Vandal guard 1000 includes a cover 1002 similar to cover 602 (FIG. 6) in vandal guard 600 (FIG. 6). Cover 1002 includes a cover plate 1008 defining an opening 1010 (FIG. 10) adjacent to a first end of cover plate 1008, a lock box 1012 mounted to the bottom of cover plate 1008 to partially coincide with opening 1010, and one or more hooks 1014 (FIG. 11) mounted to the bottom of cover plate 1008 at a second end of cover plate 1008. Lock box 1012 has a recessed portion or pocket 1016 (FIG. 11) that extends under cover plate 1008 beyond opening 1010 toward the first end of cover plate 1008. Pocket 1016 defines a slot 1018. Lock box 1012 may be rectangular with a base and four sidewalls, and slot 1018 may be defined on the base close to the first end of cover plate 1008.

Cover 1002 may include a lid 1052 (FIG. 10) that covers opening 1010 to lock box 1012. Lid 1052 may be connected by a hinge 1054 (FIG. 11) to cover plate 1008. Cover 1002 may include cutouts 1056 (FIG. 11) that accommodates portions of lock tab 1026 and cover catch 1041 that protrude above frame 1050.

Figure 12:
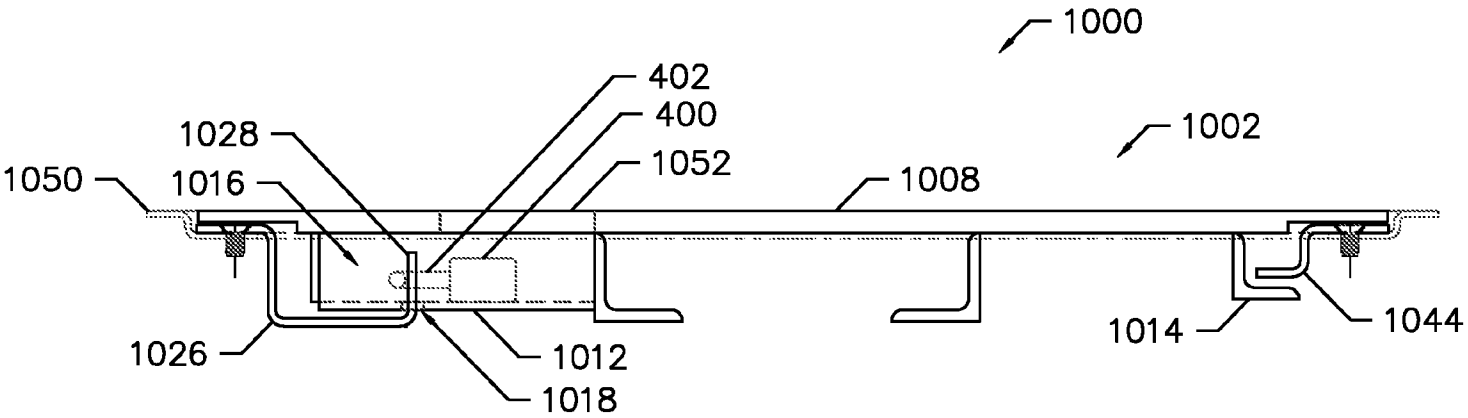
FIG. 12 is a side view of the vandal guard of FIG. 10 illustrating how a cover engages a lock tab and a cover catch fixed to an existing frame of a utility enclosure in one example of the present disclosure.

FIG. 12 is a side view of vandal guard 1000 illustrating how cover 1002 engages lock tab 1026 and cover catch 1044 fixed to frame 1050 of a utility enclosure in one example of the present disclosure. First, cover 1002 is held diagonally to engage bottom hook 1014 at its second end to cover catch 1044. Then the first end of cover 1002 is placed down so slot 1018 defined in lock box 1012 receives staple 1028 of lock tab 1026. Lock 400 (shown in phantom) is used to secure vandal guard 1000. The open end of shackle 402 is looped through staple 1028 and back into lock 400. Shackle 402 is protected under cover plate 1008 in pocket 1016 from tampering (e.g., cutting by a bolt cutter). The depth of pocket 1016 is dimensioned to match the height of shackle 402 so as to cover shackle 402 but expose at least part of the lock body to provide access to the key hole.

Figure 13:
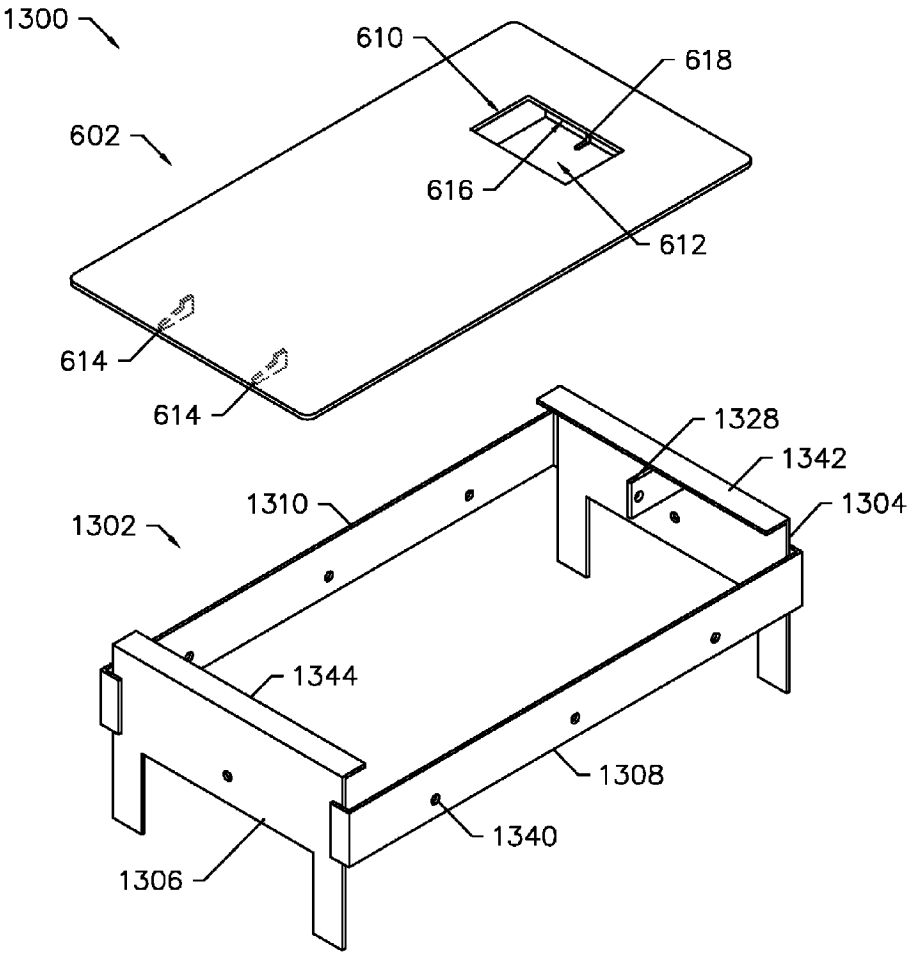
FIG. 13 is an isometric view of a vandal guard in one example of the present disclosure.
Figure 15:
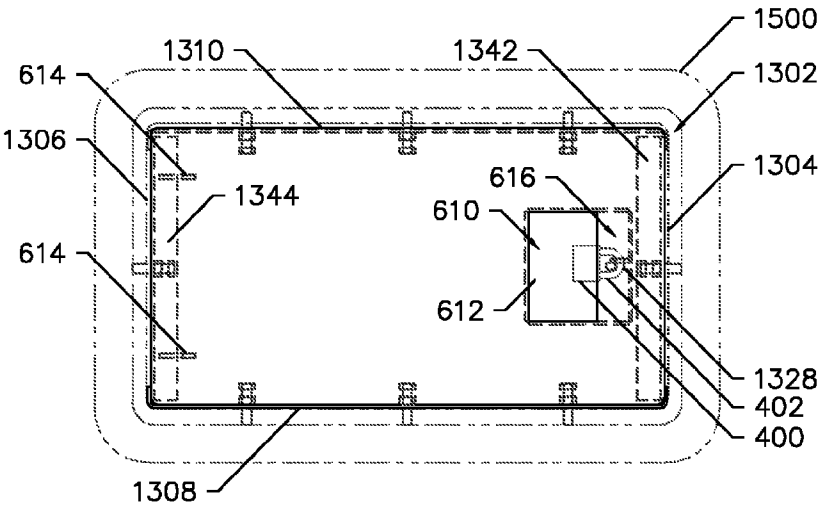

FIG. 13 is an isometric view of a vandal guard 1300 for a utility enclosure in one example of the present disclosure. Vandal guard 1300 is a variation of vandal guard 600. Vandal guard 1300 includes a cover 602 although its exact shape may be different depending on application. Instead of frame inserts, vandal guard 1300 includes a frame 1302 to be fixed to a utility enclosure 1500 as shown in FIG. 15 in one example of the present disclosure. Referring back to FIG. 13, frame 1302 includes a first vertical board 1304 with a vertical staple 1328, a second vertical board 1306 with a cover catch 1344, a first horizontal rail 1308 between vertical boards 1304 and 1306, and a second horizontal rail 1310 between vertical boards 1304 and 1306. Vertical boards 1304, 1306 and horizontal rails 1308, 1310 define fastener holes 1340 for fixing frame 1302 to the utility enclosure. First vertical board 1304 may include a horizontal tab 1342 over staple 1328.

Figure 14:
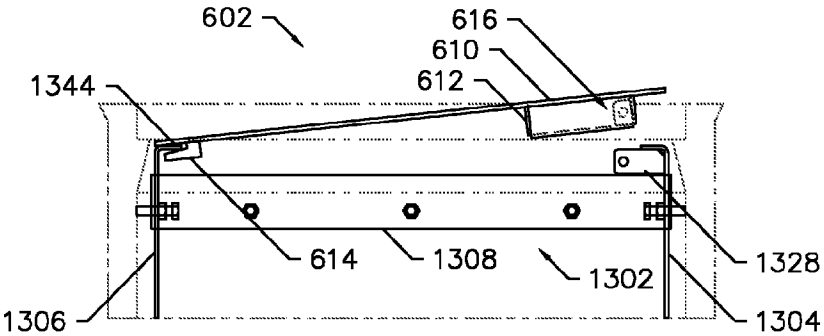
FIGS. 14 and 15 are side and plan views of the vandal guard of FIG. 13 illustrating how a cover engages a frame in one example of the present disclosure.

FIGS. 14 and 15 are side and plan views of vandal guard 1300 illustrating how cover 602 engages frame 1302 in one example of the present disclosure. First, cover 602 is held diagonally to engage bottom hook 614 at its second end to cover catch 1344. Then the first end of cover 602 is placed down so slot 618 defined in lock box 612 receives staple 1328 of frame 1302. Lock 400 (shown partially in phantom in FIG. 15) is used to secure vandal guard 1300. The open end of shackle 402 is looped through staple 1328 and back into lock 400. As described earlier, shackle 402 is protected under cover plate 608 in pocket 616 from tampering (e.g., cutting by a bolt cutter).

Figure 16:
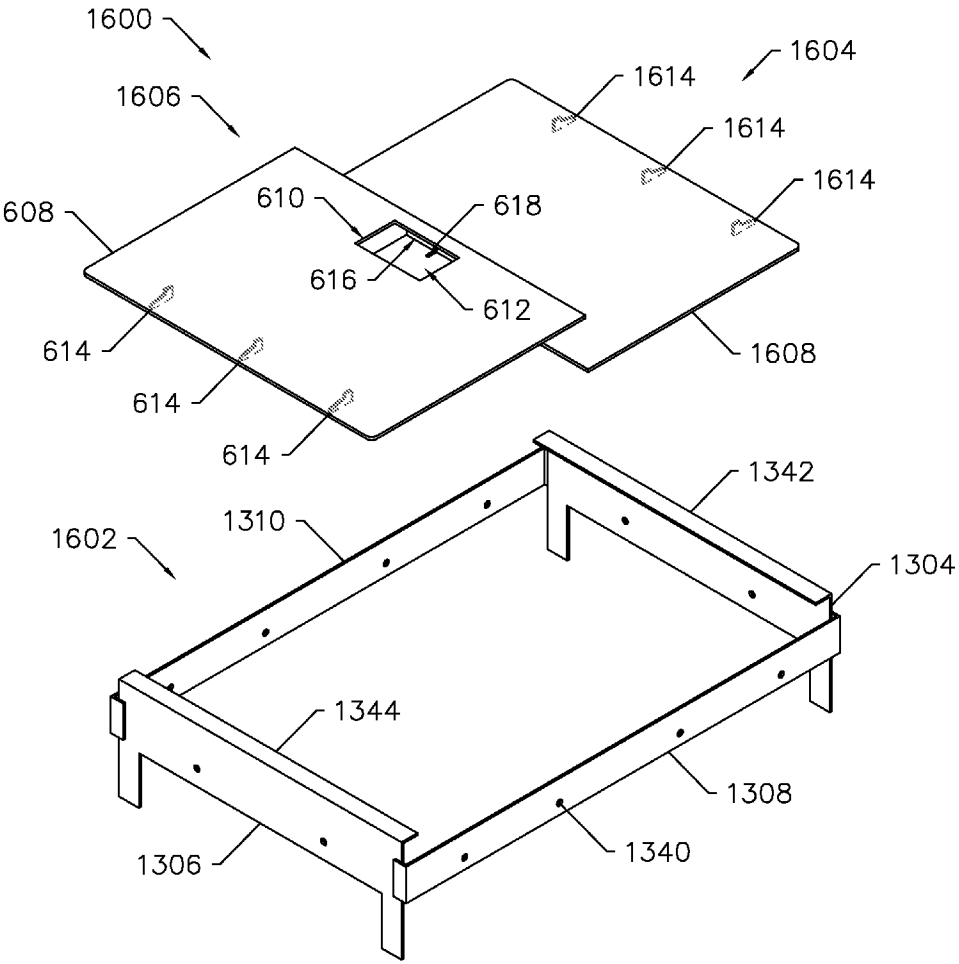
FIG. 16 is an isometric view of a vandal guard in one example of the present disclosure.
Figure 17:
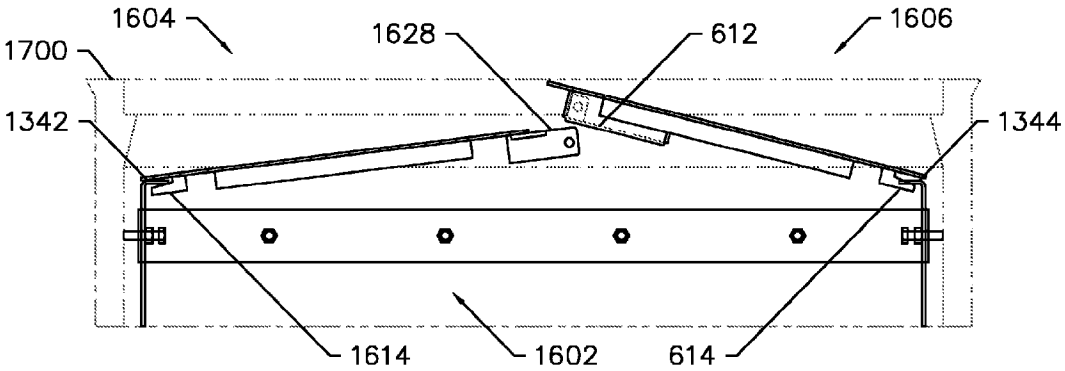
FIGS. 17 and 18 are side and plan views of the vandal guard of FIG. 16 illustrating how covers engage each other and a frame in one example of the present disclosure.

FIG. 16 is an isometric view of a vandal guard 1600 in one example of the present disclosure. Vandal guard 1600 is a variation of vandal guard 1300 (FIG. 13). Vandal guard 1600 includes a frame 1602 of the same or similar construction as frame 1302 (FIG. 13) but without a staple. Frame 1602 is fixed to a utility enclosure 1700 as shown in FIG. 17 in one example of the present disclosure. Referring back to FIG. 16, instead of a single cover, vandal guard 1600 includes a first cover 1604 and a second cover 1606. First cover 1604 includes a cover plate 1608, one or more hooks 1614 extending from the bottom of cover plate 1608 at an outer end of cover plate 1608, and a staple 1628 (FIG. 17) extending from the bottom of cover plate 1608 at an inner end of cover plate 1608. Second cover 1606 has the same or similar construction as cover 602 (FIGS. 6 and 13) although its exact shape may be different depending on application.

Figure 18:
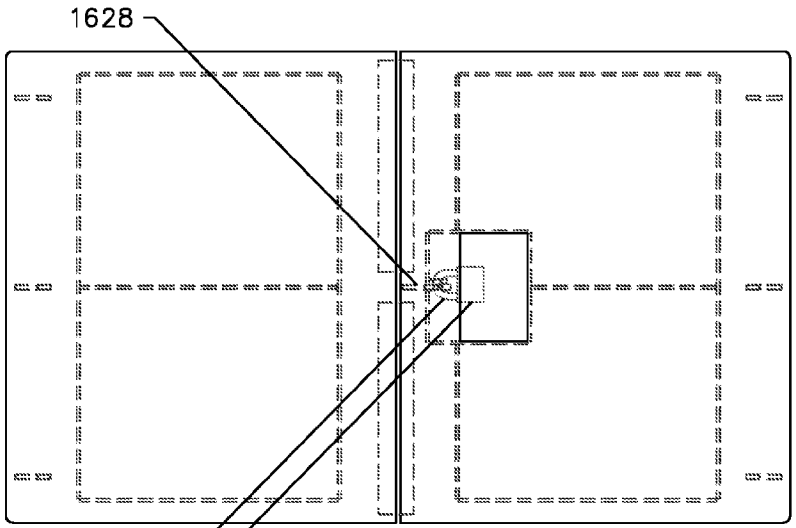

FIGS. 17 and 18 are side and plan views of vandal guard 1600 illustrating how covers 1604 and 1606 engage each other and frame 1602 in one example of the present disclosure. First, cover 1604 is held diagonally to engage bottom hook 1614 at its outer end to cover catch 1342. Then the second end of cover 1604 is placed down on frame 1602. Next cover 1606 is held diagonally to engage bottom hook 614 at its outer end to cover catch 1344. Then the inner end of cover 1606 is placed down on frame 1602 so slot 618 (FIG. 16) defined in lock box 612 receives staple 1628 of cover 1604. Lock 400 (shown partially in phantom in FIG. 18) is used to secure vandal guard 1600. The open end of shackle 402 is looped through staple 1628 and back into lock 400. As described before, shackle 402 is protected under cover plate 608 in pocket 616 from tampering (e.g., cutting by a bolt cutter).

Various other adaptations and combinations of features of the examples disclosed are within the scope of the invention. Numerous examples are encompassed by the following claims.

What is claimed is:

1. A vandal guard for a utility enclosure, comprising:
a first integral part, comprising:
a first top face;
a staple extending from the first top face; and
a first side face extending down from the first top face, the first side face being fixed relative to the first top face; and
a second integral part, comprising:
a second top face defining a slot for receiving the staple, the slot being within a perimeter of the second top face and allowing the staple to pass through the second top face;
a shackle cover extending from the second top face over the slot; and
a second side face extending down from the second top face.

2. The vandal guard of claim 1, wherein the staple comprises a vertical tab with a hole or a U-shaped bolt extending from a top surface of the first top face.

3. The vandal guard of claim 1, wherein the shackle cover comprises a U-shaped plate oriented along a length of the slot.

4. The vandal guard of claim 1, wherein the second integral part further comprises another staple adjacent to the slot.

5. The vandal guard of claim 1, wherein:
the first integral part further comprises
a first bevel corner connecting the first top face and the first side face; and
the second integral part further comprises
a second bevel corner connecting the second top face and the second side face.

6. The vandal guard of claim 5, wherein:
the first integral part further comprises one or more vertical legs extending downward from the first top face.

7. A system, comprising:
a utility enclosure defining an opening;
a vandal guard for the utility enclosure;
a first integral part, comprising:
a first top face;
a staple extending from the first top face; and
a first side face extending down from the first top face, the first side face being fixed relative to the first top face;
a second integral part, comprising:
a second top face defining a slot for receiving the staple, the slot being within a perimeter of the second top face and allowing the staple to pass through the second top face;
a shackle cover extending from the second top face over the slot; and
a second side face extending down from the second top face; and
wherein, when the staple is received in the slot, a dimension of the vandal guard from the first side face to the second side face is larger than a corresponding dimension of the opening of the utility enclosure.

* * * * *